United States Patent [19]

Zvonkovic

[11] Patent Number: 5,065,706

[45] Date of Patent: Nov. 19, 1991

[54] COOLED PLUNGER PISTON FOR INTERNAL COMBUSTION ENGINES

[75] Inventor: Josip Zvonkovic, Fellbach, Fed. Rep. of Germany

[73] Assignee: Mahle GmbH, Stuttgart, Fed. Rep. of Germany

[21] Appl. No.: 466,375

[22] PCT Filed: Mar. 25, 1988

[86] PCT No.: PCT/EP88/00760

§ 371 Date: Mar. 21, 1990

§ 102(e) Date: Mar. 21, 1990

[87] PCT Pub. No.: WO89/02982

PCT Pub. Date: Apr. 6, 1989

[30] Foreign Application Priority Data

Sep. 30, 1987 [DE] Fed. Rep. of Germany ..... 3732925

[51] Int. Cl.[5] ..... F01P 1/04

[52] U.S. Cl. ..... 123/41.35; 123/193 P

[58] Field of Search ..... 123/193 P, 41.35; 92/158, 159, 186, 189

[56] References Cited

U.S. PATENT DOCUMENTS 4,129,108 12/1978 Elsbett et al. ..... 123/193 P
4,180,027 12/1979 Taylor ..... 123/41.35

FOREIGN PATENT DOCUMENTS 0106935 5/1984 European Pat. Off. .
0171566 2/1986 European Pat. Off. .
1508412 4/1978 United Kingdom .
2188122 9/1987 United Kingdom .

*Primary Examiner*—Noah P. Kamen
*Attorney, Agent, or Firm*—Dowell & Dowell

[57] ABSTRACT

A cooled piston plunger for internal combustion engines having a separable piston head and piston shaft, wherein cooling oil is injected into an outer annular space in the piston head and distributed by oil collecting pockets of different sizes arranged in opposite relationship within the annular space at the upper end of the piston shaft to thereby uniformly distribute the desired cooling effect around the circumference of the piston head.

1 Claim, 1 Drawing Sheet

COOLED PLUNGER PISTON FOR INTERNAL COMBUSTION ENGINES

This invention relates to a cooled plunger piston for internal combustion engines of a kind having a piston head, and a piston stem mutually separate from said piston head and pivotally conncted to said head by way of a gudgeon pin.

BACKGROUND OF THE INVENTION

In the case of such a piston which is known from U.S. Pat. No. 4,180,027, one problem is that of evenly cooling the piston head over its entire periphery. As a rule, the cooling of the piston head is more intensive in the area in which the cooling oil is injected than it is in the areas remote from the cooling oil injection point. For this reason, it is already known from JP-A 56-124650 to enlarge the cooling oil space or the piston head with increasing remoteness from the injection point. This is likewise desired in the case of the piston mentioned at the outset.

To this end, it would be necessary to enlarge the annular cooling oil space at that point where it is quite remote from the point at which the cooling oil is injected. In the case of so-called articulating pistons which are articulatingly assembled from an upper piston part and a stem part, however, this requirement cannot be readily met, since the space required for the bosses, and which has to be kept clear when the piston is mounted in its stem part, makes it impossible to enlarge the cooling oil space.

OBJECT OF THE INVENTION

The object of the invention is to find a way of improving this situation.

SUMMARY OF THE INVENTION

According to the invention there is provided a cooled plunger piston for internal combustion engines comprising a) a piston head, b) a piston stem mutually separate from said piston head for pivotal connection to said head by way of a gudgeon pin, c) bosses depending from said piston head having aligned apertures for accommodating the gudgeon pin, which bosses on assembly project into the piston stem and extend in the direction of the negative pressure side of the piston to a lesser extent in the region of that end of the stem which is towards the piston head than in the region underneath and disposed in the direction of the bottom end of the stem, d) a closed annular space defined radially outwardly by said piston head, said space being open towards the piston stem, e) oil collection pockets formed in the upper end of the piston stem (2) which is towards the piston head and disposed at opposite positive and negative sides of the piston, which pockets at least partially cover the annular space of the piston head, and f) an oil injection nozzle disposed in the region of said collecting pockets for introducing cooling oil through the bottom end of the stem into the annular space of the piston head, g) said injection nozzle being so disposed that the cooling oil is only injected on one side of a diagonal plane passing through the piston stem simultaneously in the longitudinal axis of the piston and gudgeon pin, h) the area of one of said collecting pockets of the stem in the covered region of the annular space (3) and projected onto a plane extending vertically to the longitudinal axis of the piston being in the region of the negative pressure side smaller than the area of a collecting pocket on the positive pressure side of the piston, i) the smaller collecting pocket of the piston stem being radially larger in the areas disposed between the bosses of the piston head than in the areas directly adjacent the bosses, j) said larger collecting pocket having, compared with the smaller collecting pocket, the greater capacity to hold cooling oil in relation to the area covering the annular space, k) said larger collecting pocket, at its part directly opposite the bosses, being spaced from the maximum extension of the bosses in the negative pressure direction radially inwardly by a distance, said smaller collecting pocket being spaced from the maximum extension of the bosses in the positive direction radially inwardly, the spacing at the positive pressure side being at least the same size as the spacing at the negative pressure side.

BRIEF DESCRIPTION OF THE DRAWINGS

By way of example, an embodiment of the invention is shown n the accompanying drawings, in which.

DESCRIPTION OF A PREFERRED EMBODIMENT

The piston comprises a piston head 1 and a piston stem 2 which communicate soley via a gudgeon pin, not shown. The piston head is formed with a crown 1*a* recessed at the combustion side thereof and a skirt 1*b* having piston ring grooves 1*c*. Depending from the inner surface of the crown 1*a* there are formed two gudgeon pin bosses 6 which are provided with aligned apertures for receiving the gudgeon pin.

The portion of the bosses where they join the crown 1*a* defines the skirt 1*b* a closed annular space 3. The open end of the annular space 3 is substantially covered in the direction axially of the central longitudinal axis of the stem by two oil collecting pockets formed at the upper end of the stem facing the crown.

Figure 1:
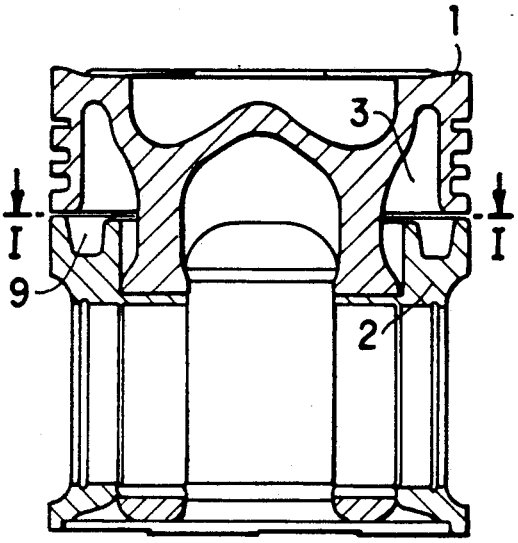
FIG. 1 shows a longitudinal section through the piston in the direction of the axis of the gudgeon pin.
Figure 2:
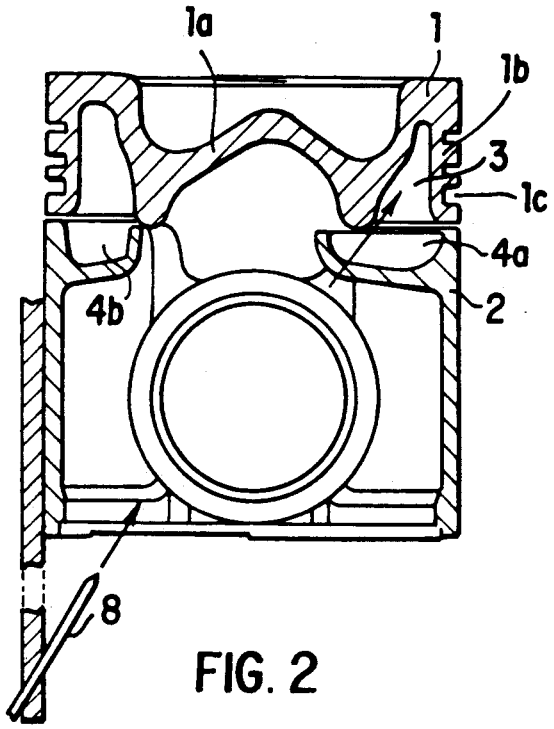
FIG. 2 shows a longitudinal section through the piston at right-angles to the gudgeon pin axis.
Figure 3:
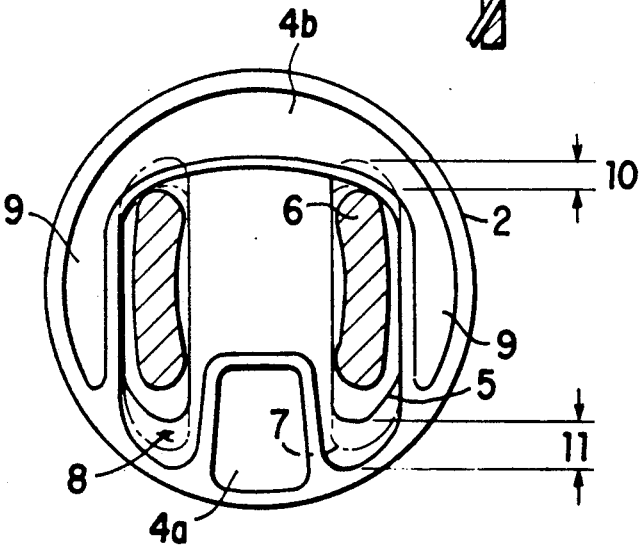
FIG. 3 is a plan view of the piston stem in the direction of the arrow I—I.

The first pocket 4*a* is substantially trapezoidal in plan and extends radially from the wall of the stem 2 to a position between the two bosses 6. The second pocket 4*b* is arcuate in plan and extends radially exteriorly of the bosses over an arc greater than one half of the circumference of the wall of the stem 2, the ends 9 of the pocket 4*b* being spaced at one side from the walls of the pocket 4*a* and at the other side from the gudgeon pin apertures. As shown in FIGS. 2 and 3 the radial length of the pocket 4*a* greater than the radial length of the pocket 4*b*.

The line 5 indicates the maximum extension of the bosses 6 in the assembled state of the piston in a direction at right-angles to the gudgeon pin axis. The dash-dotted line 7 shows the position of the bosses 6 when the stem 2 is being assembled on the piston head 1 past the bosses 6.

The view in FIG. 3 clearly shows how, on assembly, the stem 2 can be arranged asymmetrically of the bosses 6 in the direction towards the negative pressure side of the piston. The larger 4*b* of the two oil collecting pockets at the negative pressure side is spaced with a gap 10 from the maximum extension of the bosses 6 at the negative pressure side. On the positive pressure side there must be a gap 11 between the collecting pocket 4*a* and the bosses 6 on the opposite side of the bosses 6.

The cooling oil which is injected into the annular space 3 is injected via the oil injecting jet 8. The collecting pocket 4*a* which is located alongside the oil injection jet 8 at the negative pressure side is in terms of surface area and volume substantially smaller in the region directly under the annular space 3 than is the collecting pocket 4*b* disposed diagonally oppositely and beneath the annular space 3. In this way, the (in the covered area) larger of the collecting pockets 4*b*, it is assured that in the area which is most remote from that in which the cooling oil enters the annular space 3, the cooling oil available is provided in a greater quantity. In this way, it is possible to uniformly distribute the desired cooling effect over the entire periphery of the piston head.

By enlargement of the oil collecting pocket at the positive pressure side of the piston in the covered area of the annular space and reduction of the second oil collecting pocket 4*a* at the negative pressure side, the bosses can be arranged asymmetrically of the stem.

In order to be able to conduct as much as possible of the collected cooling oil and pass it to the side diagonally opposite the injection point, the depth of the pocket 4*b* can be so varied peripherally that it increases in order to guide the cooling oil to the side opposite the injection point. Preferably, as shown in the example the larger 4*b* of the pockets and its end portions 9 form one uniform and continuous pocket.

In order to cool the piston head not only in the outer annular space 3 but also in the centre of the piston crown, the smaller pocket 4*a* may project radially inwardly beyond the annular space 3. As a result, cooling oil can be passed directly to the centre of the piston head from the radially inner zone of the pocket 4*a*.

I claim:

1. A cooled plunger piston for internal combustion engines comprising a) a piston head, b) a piston stem mutually separate from said piston head for pivotal connection to said head by way of a gudgeon pin, c) bosses depending from said piston head having aligned apertures for accommodating the gudgeon pin, which bosses on assembly project into the piston stem and extend in the direction of the negative pressure side of the piston to a lesser extent in the region of that end of the stem which is towards the piston head than in the region underneath and disposed in direction of the bottom end of the stem, d) a closed annular space defined radially outwardly by said piston head, said space being open towards the piston stem, e) oil collection pockets formed in the upper end of the piston stem which is towards the piston head and disposed at opposite positive and negative sides of the piston, which pockets at least partially cover the annular space of the piston head, and f) an oil injection nozzle disposed in the region of said collecting pockets for introducing cooling oil through the bottom end of the stem into the annular space of the piston head, g) said injection nozzle being so disposed that the cooling oil is only injected on one side of a diagonal plane passing through the piston stem simultaneously in the longitudinal axis of the piston and gudgeon pin, h) the area of one of said collecting pockets of the stem in the covered region of the annular space and projected onto a plane extending vertically to the longitudinal axis of the piston being in the region of the negative pressure side smaller than the area of a collecting pocket on the positive pressure side of the piston, i) the smaller collecting pocket of the piston stem being radially larger in the areas disposed between the bosses of the piston head than in the areas directly adjacent the bosses, j) said larger collecting pocket having, compared with the smaller collecting pocket, the greater capacity to hold cooling oil in relation to the area covering the annular space, k) said larger collecting pocket, at its part directly opposite the bosses, being spaced from the maximum extension of the bosses in the negative pressure direction radially inwardly by a distance, said smaller collecting pocket being spaced from the maximum extension of the bosses in the positive direction radially inwardly, the spacing at the positive pressure side being at least the same size as the spacing at the negative pressure side.

* * * * *